US007828627B2

(12) United States Patent
Hall et al.

(10) Patent No.: US 7,828,627 B2
(45) Date of Patent: Nov. 9, 2010

(54) O.D. CENTERLESS GRINDING MACHINE

(76) Inventors: David R. Hall, 2185 S. Larsen Pkwy., Provo, UT (US) 84606; Italo Elqueta, 2185 S. Larsen Pkwy., Provo, UT (US) 84606; Dat Lieu, 2185 S. Larsen Pkwy., Provo, UT (US) 84606; Nam Lieu, 2185 S. Larsen Pkwy., Provo, UT (US) 84606; Tyson J. Wilde, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/580,385

(22) Filed: Oct. 16, 2009

(65) Prior Publication Data

US 2010/0035517 A1 Feb. 11, 2010

Related U.S. Application Data

(62) Division of application No. 11/751,527, filed on May 21, 2007, now Pat. No. 7,677,954.

(51) Int. Cl.
*B24B 49/00* (2006.01)
*B24B 51/00* (2006.01)

(52) U.S. Cl. ..... 451/5; 451/10; 451/49; 451/243; 451/331; 451/407

(58) Field of Classification Search ..... 451/5, 451/8, 9, 10, 11, 49, 243, 331, 407
See application file for complete search history.

(56) References Cited

U.S. PATENT DOCUMENTS 3,660,947 A 5/1972 Clark
3,690,072 A 9/1972 Price
4,043,767 A * 8/1977 Suda ..... 451/244
4,094,105 A 6/1978 Hatanaka
4,275,527 A * 6/1981 Daito et al. ..... 451/245
4,712,332 A * 12/1987 Smith ..... 451/5
5,554,063 A * 9/1996 Millay et al. ..... 451/9
5,569,059 A * 10/1996 Kirt ..... 451/5
5,643,051 A * 7/1997 Zhou et al. ..... 451/11
6,077,146 A 6/2000 Sato
6,083,084 A * 7/2000 Yokogawa et al. ..... 451/53
6,506,103 B1 * 1/2003 Ohmori et al. ..... 451/72
7,258,594 B2 * 8/2007 Junker ..... 451/5
7,367,868 B2 * 5/2008 Memmelaar et al. ..... 451/11
7,429,208 B1 * 9/2008 Gleason et al. ..... 451/11
7,435,157 B1 * 10/2008 Smarsh et al. ..... 451/5

* cited by examiner

*Primary Examiner*—Timothy V Eley
(74) *Attorney, Agent, or Firm*—Tyson J. Wilde

(57) ABSTRACT

In one aspect of the present invention, an outer diameter (O.D.) centerless grinding machine for use in grinding a diamond workpiece has a grinding wheel positioned parallel to a regulating wheel which is adapted to press a cylindrical workpiece into the grinding wheel as the regulating wheel rotates. Electronic equipment may be adapted to adjust a pressure of the regulating wheel against the grinding wheel. Also, a carrier may be adapted to house the workpiece, the carrier being attached to a translation mechanism adapted to move the carrier between the wheels such that the workpiece is in contact with both wheels.

16 Claims, 7 Drawing Sheets

O.D. CENTERLESS GRINDING MACHINE

This application is a divisional of U.S. patent application Ser. No. 11/751,527 filed May 21, 2007 now U.S. Pat. No. 7,677,954 to Hall and entitled OD Centerless Grinding Machine.

BACKGROUND OF THE INVENTION

This invention relates to centerless grinding machines. More particularly to an outer diameter (O.D.) grinding machine for grinding cylindrical workpieces comprising diamond. In some applications a grinding machine is used to shape and finish a diamond workpiece after being sintered in a high temperature high pressure press. There are a number of problems that arise during grinding that slow production and may compromise the quality of the workpieces. Precision grinding is often difficult to achieve requiring that the workpieces run through a grinding process multiple times. The workpieces are often run across a grinding wheel and measured after each pass; usually resulting in recalibrating the grinding machine and running the piece through the machine again to minimize the blemishes created during the previous passes.

Such problems have been addressed in U.S. Pat. No. 6,077,146, to Sato, et al., which is herein incorporated by reference for all that it contains. The '146 patent discloses a taper correcting apparatus for a grinding machine, a workpiece supporting means for supporting a workpiece in parallel with the grinding wheel, and a cutting and feeding device which moves back and forth a cylindrical grinding wheel with respect to the workpiece. The patent also discloses a pair of grinding wheel bearing pedestals which rotatably support ends of the grinding wheel spindle via bearings with respect to the wheel slide, respectively. A first grinding wheel bearing pedestal support which is fixed to the wheel bearing pedestal support with is fixed to the wheel slide, and which clampingly supports one of the grinding wheel bearing pedestals is disclosed along with a second grinding wheel bearing pedestal support which is attached so as to be rotatable about a round shaft, and which clampingly supports another one of the grinding wheel bearing pedestals, the round shaft being attached below the grinding wheel spindle to the wheel slide in parallel with the center line of the workpiece. The invention also discloses a pressuring device which presses the second grinding wheel bearing pedestal support to rotate the second grinding wheel bearing pedestal support about the round shaft, thereby changing a distance between a center of the grinding wheel spindle and a center of the workpiece. Means for controlling a pressing amount of the pressuring device so that parallelism between the center line of the workpiece and a center line of the grinding wheel spindle is corrected is disclosed.

BRIEF SUMMARY OF THE INVENTION

In one aspect of the present invention, an outer diameter centerless grinding machine for use in grinding a diamond workpiece has a grinding wheel positioned parallel to a regulating wheel which is adapted to press a cylindrical workpiece into the grinding wheel as the regulating wheel rotates. It may be beneficial to position the wheels parallel to each other so that the outer diameter of the diamond workpiece may be evenly grinded and wear on the wheels may be evenly distributed. Electronic equipment may be incorporated into the grinding machine and may be adapted to adjust a pressure of the regulating wheel against the grinding wheel. Also, a carrier may be adapted to house the workpiece, the carrier being attached to a translation mechanism adapted to linearly move the carrier between the wheels such that the workpiece is in contact with both wheels.

The grinding wheel may be a resin bonded diamond wheel. The translation mechanism may be bidirectional in that the carrier is adapted to move the workpiece back and forth between the wheels. The carrier may be driven by a motor or may be attached to a hydraulic circuit adapted to move the carrier. The carrier may be attached to a chain adapted to move the carrier. The carrier may be slideably supported by an arm positioned proximate a gap between the wheels. A translation mechanism adapted to move the carrier may be attached to the arm. The electronic equipment may have a closed loop system adapted to change the pressure according to sensed conditions such as material hardness, wheel torque, heat, pressure, time of operation, vibration or a combination thereof. The carrier may house a plurality of workpieces at one time. The grinding machine may have a loader apparatus that loads the workpieces into the carrier. The loader apparatus may be adapted to unload and sort the carriers based on sensed dimensions of the workpiece. The loader apparatus may also comprise a plurality of carriers. This may be beneficial in that after multiple carriers are manually loaded with workpieces, the grinding machine may run for a period of time without having to be manually reloaded. The machine may also have a sensor adapted to measure a dimension of the cylindrical workpiece. The grinding wheel may rotate faster than the regulating wheel during an operation. Also, the grinding wheel may have a larger diameter than the regulating wheel.

In another aspect of the invention, a method has steps for grinding an outer diameter of a diamond workpiece. A grinding wheel parallel to a regulating wheel may be adapted to support a workpiece. A workpiece supported by a carrier may be moved between the wheels while the wheels are rotating. A force may be applied to the workpiece from the regulating wheel such that the workpiece is in contact with both wheels. An operating condition may be sensed. By loading the sensed condition into an input field of a closed loop system, an operating parameter may be adjusted in response to the sensed condition. In some embodiments, the sensed condition may be a material hardness, wheel torque, heat, pressure, time of operation, vibration or a combination thereof. The parameter may be pressure, wheel speed, or a combination thereof.

DETAILED DESCRIPTION OF THE INVENTION AND THE PREFERRED EMBODIMENT

Figure 1:
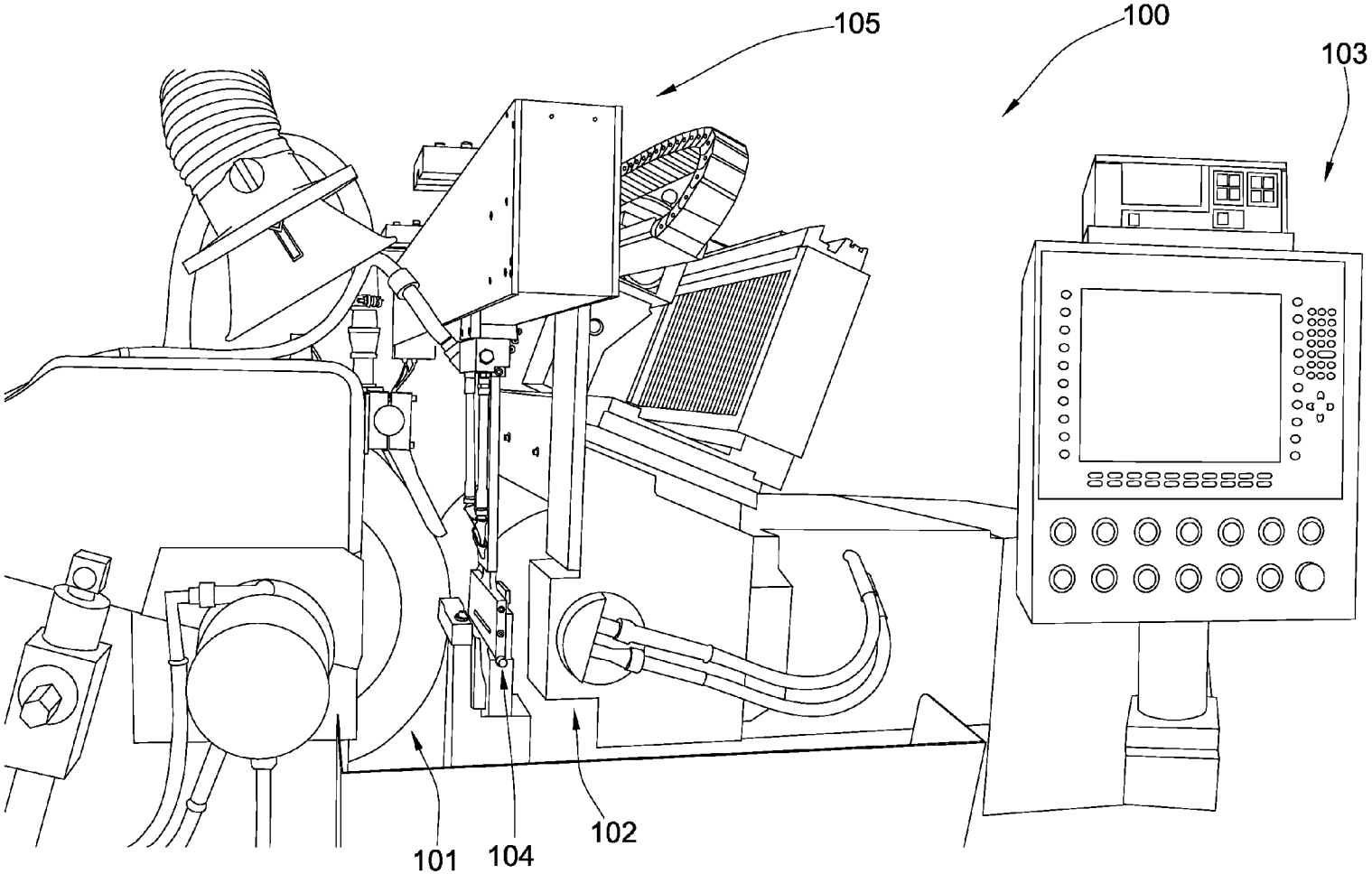
FIG. 1 is a perspective diagram of an embodiment of a grinding machine.

FIG. 1 is a perspective diagram of a grinding machine 100. The grinding machine 100 may have a grinding wheel 101 positioned parallel to a regulating wheel 102 which is adapted to press a cylindrical workpiece into the grinding wheel 101 as the regulating wheel 102 rotates. Electronic equipment 103 may be adapted to adjust a pressure of the regulating wheel 102 against the grinding wheel 101. A carrier 104 may be adapted to house the workpiece. The carrier 104 may be attached to a translation mechanism 105 that may linearly move the carrier 104 between the wheels 101, 102, such that the workpiece is in contact with both wheels 101, 102. The carrier 104 may house a plurality of workpieces. The grinding wheel 101 may be a resin bonded diamond wheel.

The translation mechanism 105 may be bidirectional in that it moves the carrier 104 linearly back and forth between the wheels 101, 102. The electronic equipment 103 may have a closed loop system adapted to change the pressure according to sensed operating conditions such as material hardness, wheel torque, heat, pressure, time of operation, vibration or a combination thereof.

Figure 2:
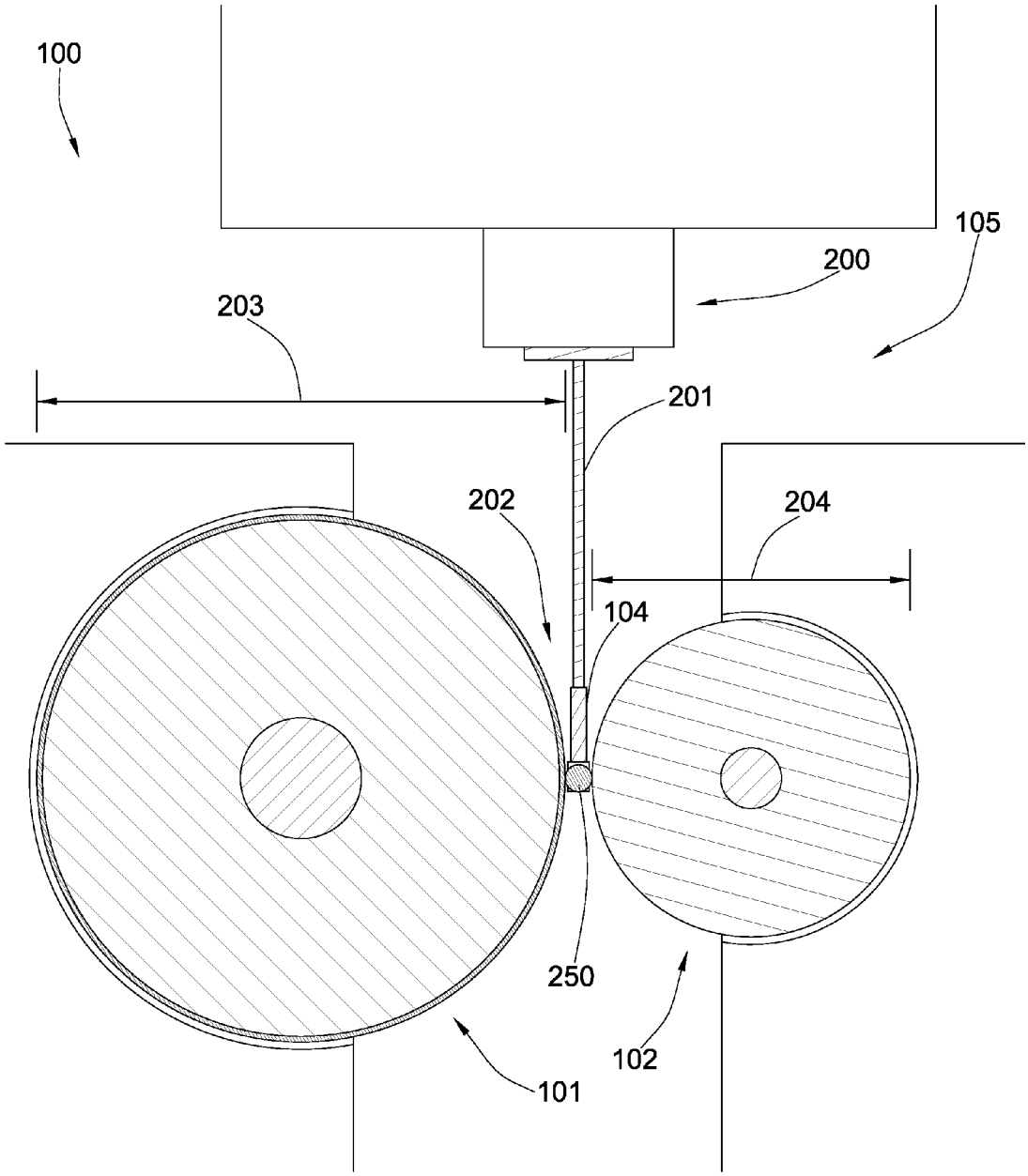
FIG. 2 is a cross-sectional diagram of an embodiment of a grinding machine.

FIG. 2 is a cross-sectional diagram of a grinding machine 100. In the preferred embodiment, a carrier 104 may be passed back and forth between two parallel wheels 101, 102, such that workpieces 250 housed in the carrier 104 contact both wheels as the wheels rotate. The regulating wheel 102 may rotate such that it rotates the diamond workpieces 250 against the grinding wheel as it rotates. It is believed that by positioning the wheels 101, 102, parallel to each other, fewer passes through the grinding machine may be required to grind a diamond workpiece 250 to its desired shape and size as tapering of the diamond workpiece 250 may not need to be corrected during an operation. Also, wear on the wheels may be evenly distributed, and thus, minimized. Operating conditions such as material hardness, wheel torque, heat, pressure, operation time, vibration, workpiece dimensions or a combination may be sensed during an operation. The sensed conditions may be used to make adjustments to operating parameters to evenly and accurately grind the diamond workpieces 250. The operating parameters may include wheel pressure or wheel speed. By adjusting the pressure the regulating wheel 102 applies on the workpiece 250 against the grinding wheel 101, the workpiece 250 may be more coarsely ground or more finely ground. Adjusting the pressure may also help to shape the workpiece 250 to the desired cylindrical shape.

The carrier 104 may be attached to a translation mechanism 105 adapted to linearly move the carrier between the wheels 101, 102. The carrier 104 may be driven by a motor 200. A hydraulic circuit or a chain may be attached to the carrier 104 and may be adapted to move the carrier 104. The carrier 104 may also be slideably supported by an arm 201 positioned proximate a gap 202 between the wheels 101, 102.

The grinding wheel 101 may have a diameter 203 larger than a diameter 204 of the regulating wheel 102. Also, the grinding wheel 101 may be adapted to rotate faster than the regulating wheel 102.

Figure 3:
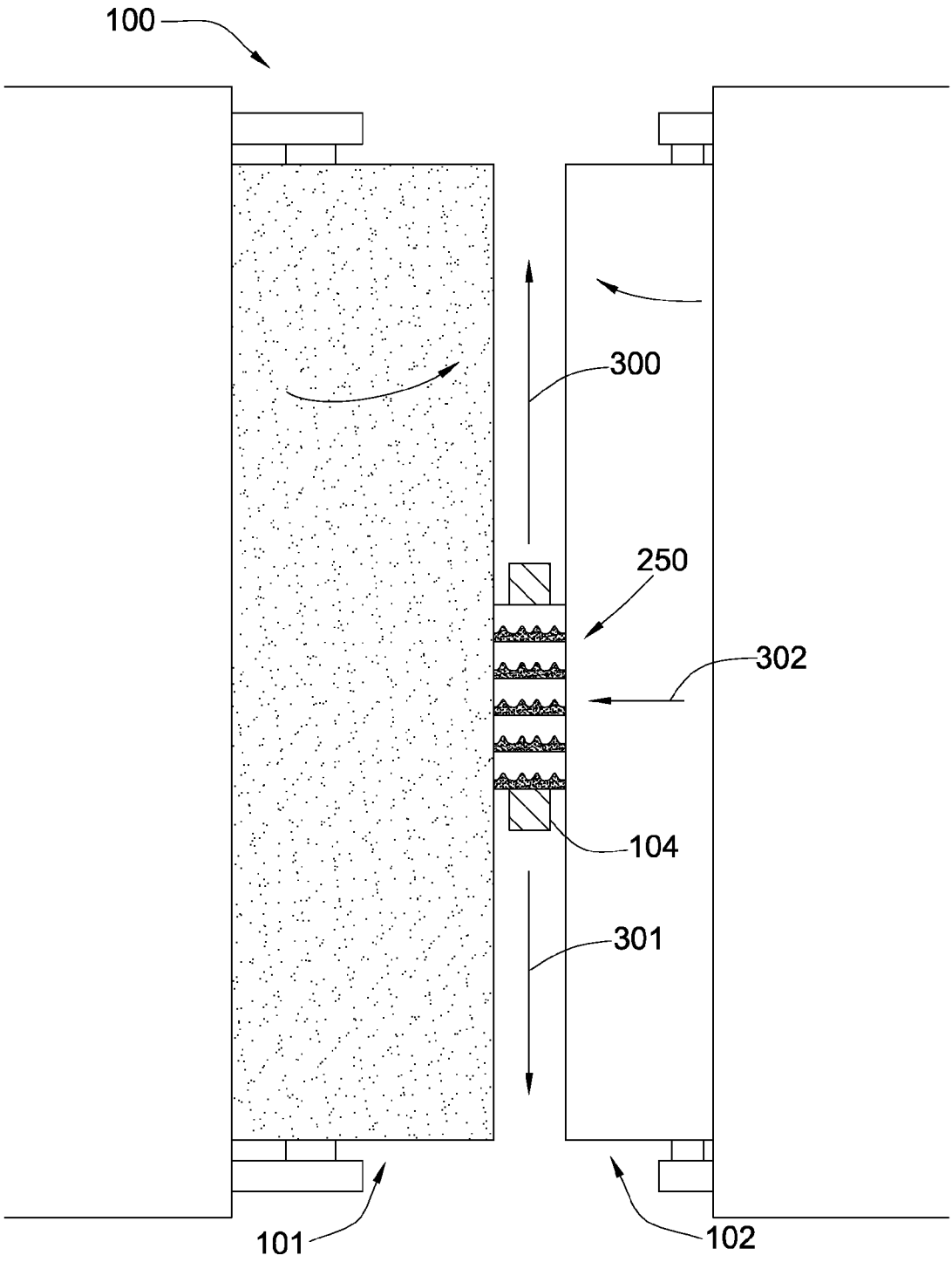
FIG. 3 is a perspective diagram of another embodiment of a grinding machine.

Referring now to FIG. 3, the grinding wheel 101 and the regulating wheel 102 of the grinding machine 100 are positioned parallel to each other as the carrier 104, housing the diamond workpieces 250, may be adapted to move linearly either in a direction 300 or in another direction 301. During an operation, the regulating wheel 102 may press the workpieces 250 into the grinding wheel 101 as the regulating wheel 102 rotates. A pressure, as indicated by an arrow 302, against the workpieces 250 may be adjusted so that the workpieces 250 may be grinded into a desired size and shape. For example, one function of the grinding wheel is to grind through a can or a casing surrounding the workpiece after being formed in a press. Typically the workpiece comprises a diamond bonded to a tungsten carbide substrate. Since the cans or casing are typically made of a metal which is significantly softer than both the carbide and diamond, less applied pressure may be required to grind off the can. Once through the softer material, the applied pressure may be increased to a desired finish and size of the diamond work piece. Finally, less pressure may be required during the final stages of grinding the workpiece in order to achieve a smooth finish. Sensors may determine a condition associated with the grinding process such as the hardness of a material currently being ground through, wheel torque, heat generated, pressure on the wheel, time of operation, wheel vibration, or a combination thereof to optimize the grinding parameters at the various stages of grinding. The sensed conditions may be sent to and loaded into fields programmed in the electronic equipment. The electronic equipment may be part of a closed loop system so that parameters, such as the pressure 302, may be adjusted. In the above example, a sensor may determine a change in the material hardness or a change in the diameter of the workpiece once the metal is ground off, exposing the harder, diamond workpiece. The electronic equipment may increase the pressure 302 of the regulating wheel 102 in order to grind the diamond workpiece.

Figure 4:
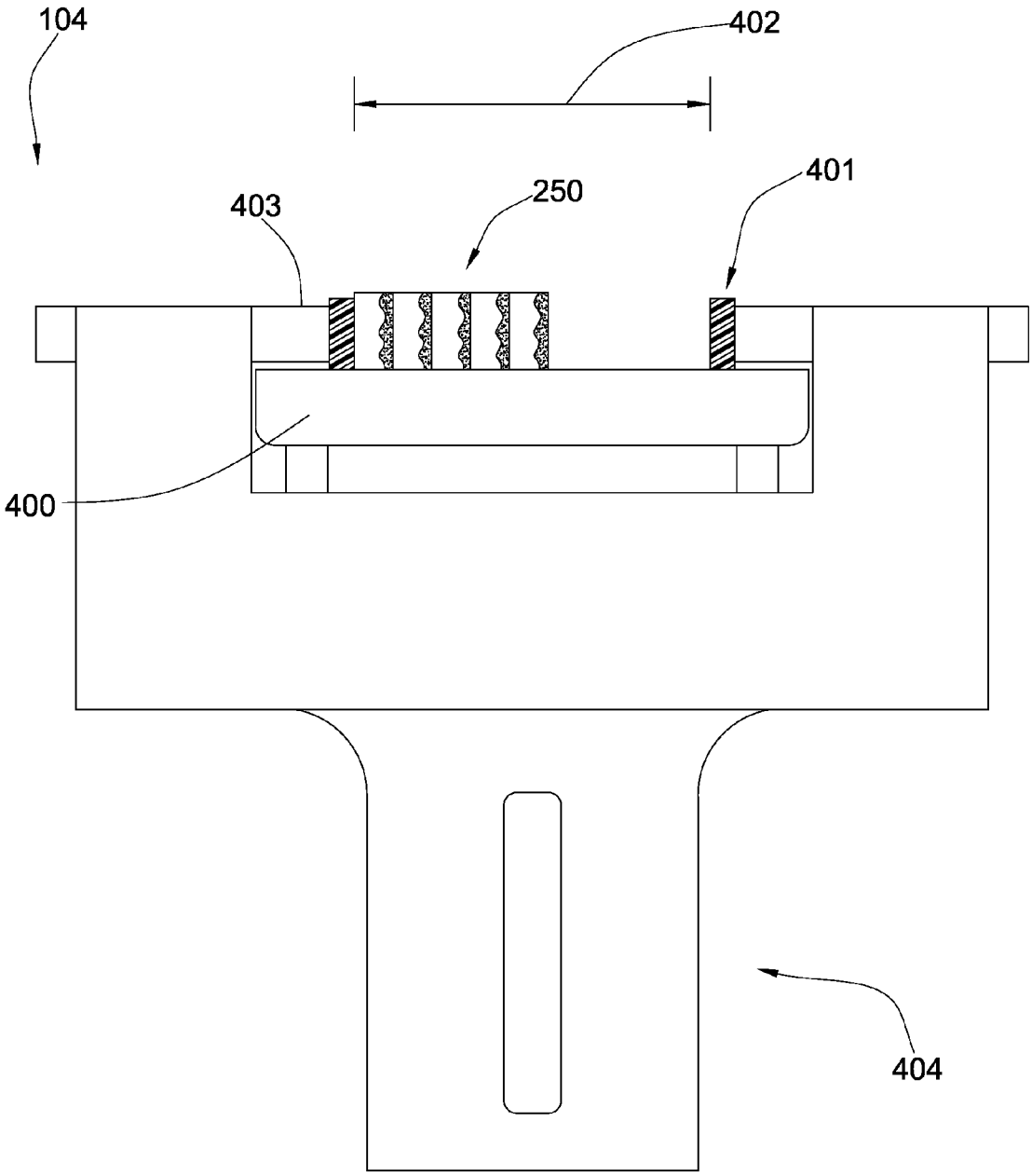
FIG. 4 is a perspective diagram of an embodiment of a carrier.

In the embodiment of FIG. 4, a carrier 104 may house a plurality of workpieces 250. The workpieces 250 may be supported by a tray 400 of the carrier 104. The carrier 104 may also comprise two ends 401 adapted to clamp the workpieces 250 together. The two ends 401 may rotate as the diamond workpieces rotate during an operation, thus the workpieces 250 may be rotationally isolated from the carrier while supported by the tray 400. A distance 402 between the two ends 401 may be adjusted so that the desired number of workpieces 250 may be securely held in the carrier 104. The workpieces 250 may protrude beyond a leading edge 403 of the carrier 104 and may have a diameter greater than the width of the carrier 104 so that the carrier does not contact the grinding wheel or the regulating wheel during an operation, but allows the workpieces to contact both wheels. A base 404 of the carrier 104 may be adapted for attachment to an arm, the arm being driven by a motor or other translation mechanism. During a grinding operation, the carrier 104 may move linearly between a grinding wheel and a regulating wheel positioned parallel to each other so that the outer diameter of the workpieces 250 contacts the two wheels. The carrier 104 may be attached to a hydraulic circuit or a chain adapted to move the carrier 104 between the two wheels.

Figure 5:
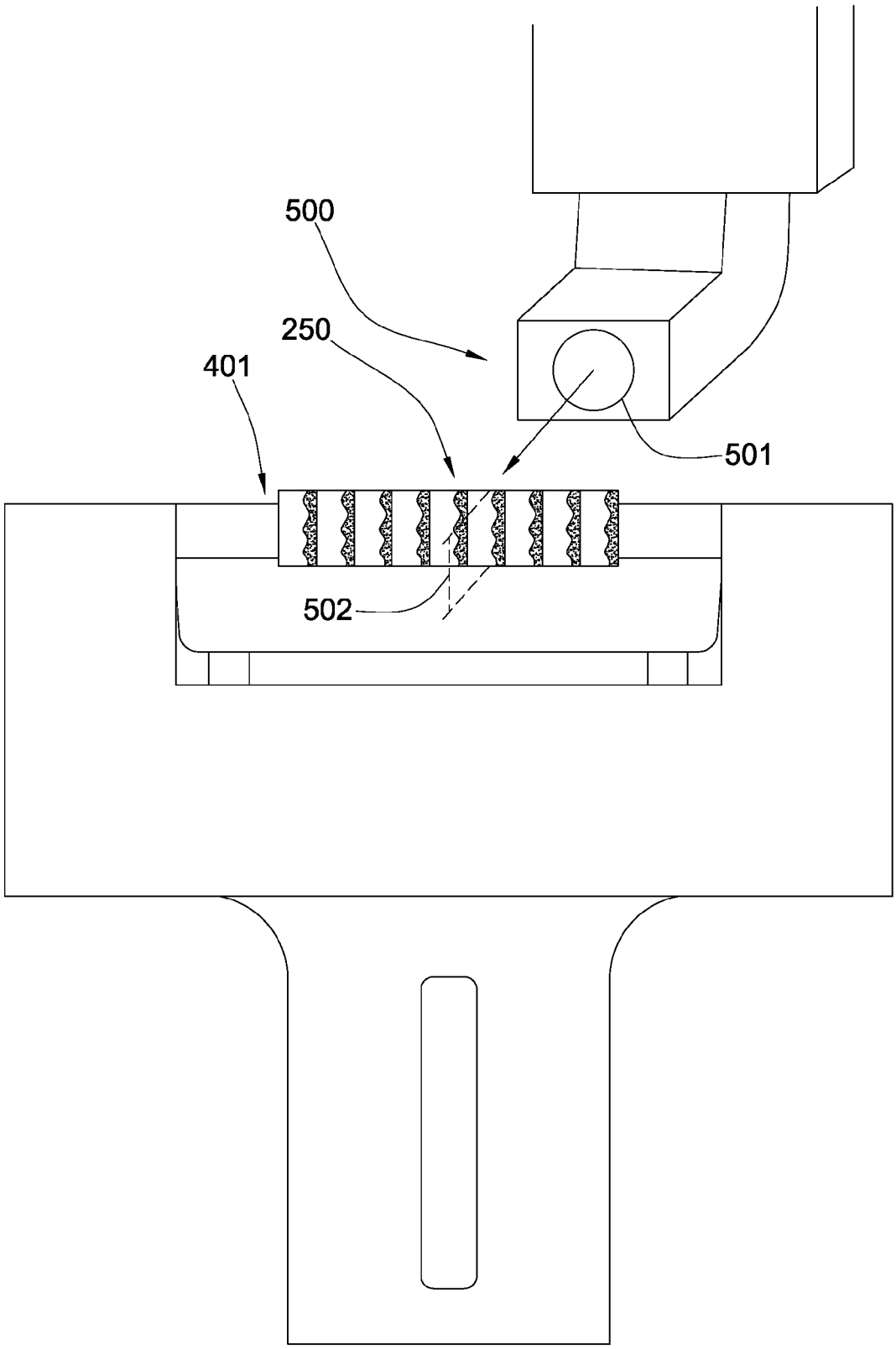
FIG. 5 is a perspective diagram of another embodiment of a carrier.

Referring now to FIG. 5, the carrier 104 may house a plurality of workpieces 250 between the two ends 401. A sensor 500 may be attached to the grinding machine and may be adapted to measure a dimension of the cylindrical workpiece 250. In this embodiment, the sensor may be a laser 501 adapted to sense the diameter of the workpieces. The diameter 502 of the workpiece 250 may decrease over time during an operation. The sensor may determine if the workpieces requires more grinding or if the workpiece is finished. The sensor 500 may determine the diameter 502 and send the information to electronic equipment which may adjust other parameters of the grinding machine, such as the pressure applied on the workpieces by the regulating wheel. In other embodiments, the sensor may be a camera which may optically measure various dimensions of the workpiece.

Figure 6:
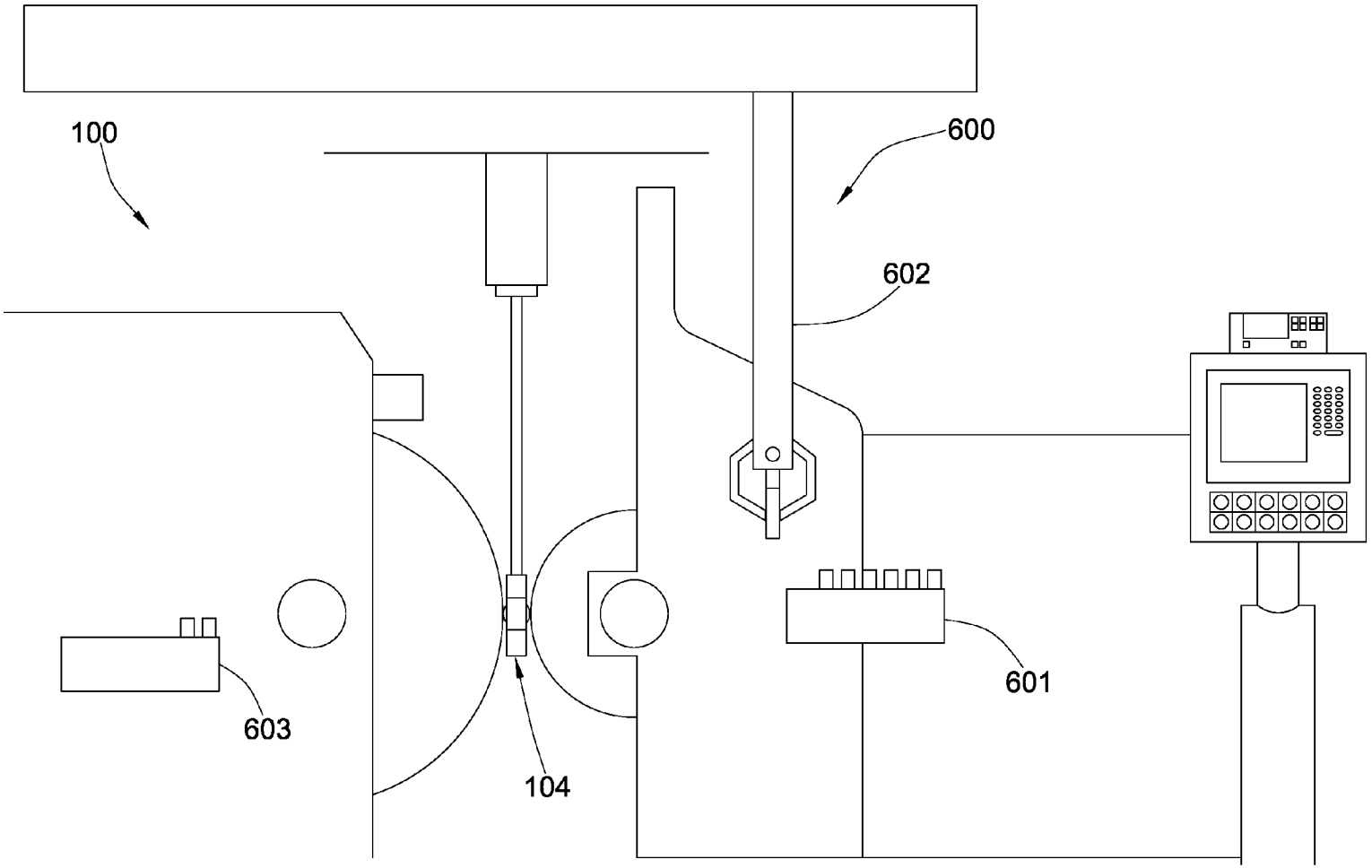
FIG. 6 is a perspective diagram of another embodiment of a grinding machine.

FIG. 6 shows another embodiment of a grinding machine 100. The grinding wheel 101 positioned parallel to the regulating wheel 102 may grind the outer diameter of a workpiece housed in a carrier 104. A translation mechanism 105 may move the carrier 104 linearly between the wheels 101, 102 in two directions so that the outer diameter of the workpiece contacts both wheels 101, 102. Electronic equipment 103 may be adapted to adjust a pressure of the regulating wheel 102 against the grinding wheel 101. The electronic equipment may have a closed loop system and may change the pressure according to a sensed operating condition.

In this embodiment, a loader apparatus 600 may be adapted to attach the carrier 104 to the arm. The loader apparatus may have a plurality of carriers 104 stored in a compartment 601 disposed on a side of the grinding machine 100. Each of the plurality of carriers 104 may be preloaded with a plurality of workpieces. For example, workpieces may be manually loaded into a plurality of carriers and then placed in the compartment. This may be beneficial in that the grinding machine may continuously run for a period of time without having to be manually reloaded after each carrier is finished. This may save time in the grinding process. A loading arm 602 of the loader apparatus 600 may be adapted to retrieve a carrier from the compartment 601 and load the carrier into the grinding machine 100. The loading arm 602 may be attached to a motor. The loading arm 602 may also be adapted to retrieve a carrier from the grinding machine 100 once the workpieces housed in the carrier 104 are finished being grinded. In this embodiment, the loading arm 602 may place the finished carriers in another compartment 603 disposed on a side of the grinding machine 100.

In other embodiments, a sensor may determine the dimensions of the finished workpiece and may use electronic equipment to distinguish between the workpieces with acceptable dimensions and workpieces with unacceptable dimensions, or workpieces that may require a manual inspection. The arm may then separate these carriers into appropriate compartments. It is believed that the workpieces in each carrier comprise the same dimensions when the grinding process is completed. Thus, the carriers may be separated as a whole without having to separate out individual workpieces.

Figure 7:
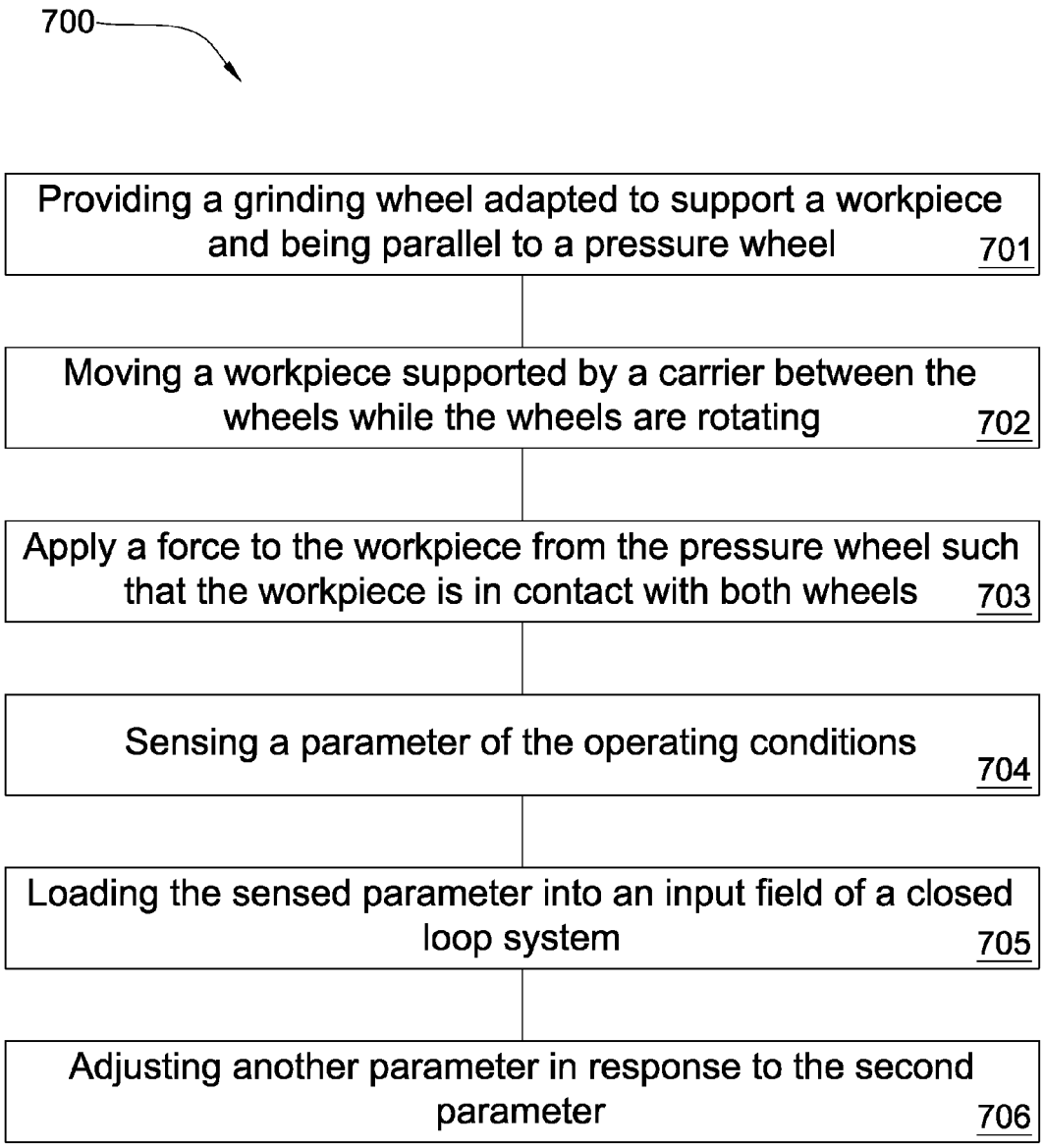
FIG. 7 is a flow chart illustrating one embodiment of a method for grinding an outer diameter of a workpiece.

FIG. 7 is a diagram of an embodiment of a method 700 for grinding an outer diameter of a diamond workpiece. The method 700 includes providing 701 a grinding wheel adapted to support a workpiece and being parallel to a regulating wheel. The method 700 also includes moving 702 a workpiece supported by a carrier between the wheels while the wheels are rotating. The regulating wheel may be adapted to rotate the carrier housing the workpiece. The method 700 further includes applying 703 a force to the workpiece from the regulating wheel such that the workpiece is in contact with both wheels. The method 700 includes sensing 704 an operating condition as well as loading 705 the sensed condition into an input field of a closed loop system. The method 700 also includes adjusting 706 an operating parameter in response to the sensed conditions. The sensed condition may be a material hardness, wheel torque, heat, pressure, time of operation, vibration, workpiece dimensions, or a combination thereof. The parameters may be pressure, wheel speed, or a combination thereof.

Whereas the present invention has been described in particular relation to the drawings attached hereto, it should be understood that other and further modifications apart from those shown or suggested herein, may be made within the scope and spirit of the present invention.

What is claimed is:

1. A method for grinding an outer diameter of a diamond workpiece, comprising the steps of:

providing a grinding wheel adapted to support a workpiece and being parallel to a regulating wheel;

moving a workpiece supported by a carrier between the wheels while the wheels are rotating;

applying a force to the workpiece from the regulating wheel such that the workpiece is in contact with both wheels, sensing an operating condition;

loading the sensed condition into an input field of a closed loop system;

adjusting a parameter in response to the sensed condition; and wherein moving the workpiece is accomplished by a translation mechanism.

2. The method of claim 1, wherein the sensed condition is a material hardness, wheel torque, heat, pressure, time of operation, vibration, workpiece dimensions or a combination thereof.

3. The method of claim 1, wherein the parameter is pressure, wheel speed, or a combination thereof.

4. The method of claim 1, wherein moving the workpiece is accomplished by a translation mechanism.

5. The method of claim 1, wherein the translation mechanism is bi-directional.

6. The method of claim 1, wherein the carrier is attached to the translation mechanism by an arm.

7. The method of claim 1, wherein the translation mechanism is driven by a motor.

8. The method of claim 1, wherein the translation mechanism is driven by a chain.

9. The method of claim 1, wherein the translation mechanism is driven by a hydraulic circuit.

10. The method of claim 1, wherein the grinding wheel comprises a larger diameter than the regulating wheel.

11. The machine of claim 1, wherein the machine comprises a sensor adapted to measure a dimension of the workpiece.

12. The machine of claim 1, wherein the carrier houses a plurality of workpieces.

13. The machine of claim 1, wherein the grinding wheel is adapted to rotate faster than the regulating wheel.

14. The machine of claim 1, wherein the grinding machine comprises a loader apparatus adapted to load a plurality of carrier.

15. The machine of claim 14, wherein the loader apparatus comprises a plurality of carriers.

16. The machine of claim 14, wherein the loader apparatus is adapted to unload and sort the carriers.

* * * * *